US007664423B2

(12) United States Patent
Sasai

(10) Patent No.: US 7,664,423 B2
(45) Date of Patent: Feb. 16, 2010

(54) IMAGE FORMING DEVICE INCLUDING A CLEANING MEMBER

(75) Inventor: Takahiro Sasai, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 906 days.

(21) Appl. No.: 11/264,351

(22) Filed: Oct. 5, 2005

(65) Prior Publication Data

US 2006/0093390 A1 May 4, 2006

(30) Foreign Application Priority Data

Oct. 29, 2004 (JP) ..... 2004-317191
Oct. 29, 2004 (JP) ..... 2004-317240

(51) Int. Cl.
*G03G 15/02* (2006.01)

(52) U.S. Cl. ..... 399/100

(58) Field of Classification Search ..... 399/91, 399/98, 99, 100, 170
See application file for complete search history.

(56) References Cited

U.S. PATENT DOCUMENTS 5,089,848 A * 2/1992 Kusuda et al. ..... 399/100 X
5,194,897 A * 3/1993 Yoshiyama et al. ..... 399/100
5,392,099 A * 2/1995 Kusumoto et al. ..... 399/100
6,205,303 B1 * 3/2001 Fujii et al. ..... 399/100
6,449,447 B1 * 9/2002 Regelsberger et al. ..... 399/100
6,711,363 B1 * 3/2004 Wayman ..... 399/100 X

FOREIGN PATENT DOCUMENTS

| | | |
|---|---|---|
| JP | 08-272196 | 10/1996 |
| JP | 09-258528 | 10/1997 |
| JP | 11-024375 | 1/1999 |
| JP | 2003-295537 | 10/2003 |

* cited by examiner

*Primary Examiner*—Sandra L Brase
(74) *Attorney, Agent, or Firm*—Keating & Bennett, LLP

(57) ABSTRACT

An image forming device includes a photoconductive drum, a discharge electrode which discharges corona onto a surface of the photoconductive drum, and a cleaning member which cleans the discharge electrode by moving on the discharge electrode. The image forming device further includes a detection device, which is arranged on one of a first side and a second side in a moving direction of the cleaning member, and detects a current value of an electric current discharged from the discharge electrode.

14 Claims, 6 Drawing Sheets

IMAGE FORMING DEVICE INCLUDING A CLEANING MEMBER

BACKGROUND OF THE INVENTION

1. Field of the Invention

The present invention relates to an image forming device, and in particular, relates to an image forming device including a photoconductive drum unit having a discharge electrode which discharges corona onto a surface of a photoconductive drum, and a cleaning member which cleans the discharge electrode.

2. Description of the Related Art

Conventionally, a photoconductive drum unit of an image forming device includes a discharge electrode (for example, a discharge wire) , which discharges corona onto a surface of a photoconductive drum, and a cleaning member which removes a foreign substance that is adhered on the discharge electrode. When the cleaning member moves on the discharge electrode, the foreign substance adhered on the discharge electrode is removed.

The conventional image forming device can clean the discharge electrode. However, the conventional image forming device cannot determine which portion of the discharge electrode is contaminated, and cannot determine a life-span of the discharge electrode. Therefore, when a failure occurs in the photoconductive drum unit, a determination cannot be made as to whether the failure results from the contamination of the discharge electrode or results from the end of the life-span of the discharge electrode.

SUMMARY OF THE INVENTION

In order to overcome the problems described above, preferred embodiments of the present invention permit a contamination or a life-span of a discharge electrode to be easily determined.

According to a preferred embodiment of the present invention, an image forming device includes a discharge electrode and a cleaning member. The discharge electrode discharges corona onto a surface of a photoconductive drum. The cleaning member cleans the discharge electrode by moving along the discharge electrode. A detector is arranged on at least one of a first side and a second side of the cleaning member in a moving direction of the cleaning member. The detector detects a current value of an electric current discharged from the discharge electrode.

According to the above-described preferred embodiment, in case the detector is arranged on either one of the first side and the second side of the cleaning member in the moving direction of the cleaning member, when the cleaning member is moving on the discharge electrode, the detector detects the current value of the electric current discharged from the discharge electrode. Accordingly, the current value can be detected at the same time as cleaning the discharge electrode, and a life-span of the discharge electrode can be determined from the detected current value. Moreover, since the detector is arranged on the cleaning member, compared with a structure in which the detector is provided on another member that is moved along the discharge electrode, the number of components can be reduced. As a result, the image forming device can be decreased in size. In case the detector is arranged on both the first side and the second side of the cleaning member in the moving direction of the cleaning member, just by moving the cleaning member along the discharge electrode towards the first side (in other words, one-way movement), the detector can detect both a current value of an electric current discharged from the discharge electrode prior to a cleaning operation and a current value of an electric current discharged from the discharge electrode after the cleaning operation. Accordingly, a period of time required for the detection of the current value can be shortened considerably.

According to another preferred embodiment of the present invention, the detector detects both a first current value prior to the cleaning operation and a second current value after the cleaning operation. The detected first current value and the detected second current value are preferably compared.

According to this preferred embodiment, an effect of the cleaning operation by the cleaning member can be easily confirmed, and a determination can be easily made as to the portion where an additional cleaning operation is necessary. When the desired results of the cleaning operation performed by the cleaning member cannot be confirmed, a determination can be easily made that the life-span of the discharge electrode has ended.

According to another preferred embodiment of the present invention, when the comparison device determines that a difference between the first current value and the second current value is equal to or greater than a prescribed threshold value, a determination is made that the life-span of the discharge electrode has ended.

According to this preferred embodiment, when the comparison device determines that the difference between the first current value and the second current value is equal to or greater than the prescribed threshold value, a determination is made that the life-span of the discharge electrode has ended. Therefore, a service person can easily determine when the life-span of the discharge electrode has ended.

According to another preferred embodiment of the present invention, an image forming device includes a discharge electrode and a grid electrode. The discharge electrode discharges corona onto a surface of a photoconductive drum. The grid electrode is provided along a direction in which the discharge electrode extends. A detector, which detects a current value of an electric current discharged from the discharge electrode, is provided on the grid electrode.

According to the present preferred embodiment, the detector is provided on the grid electrode which is provided along the direction in which the discharge electrode extends. Therefore, the current value of the electric current discharged from the discharge electrode can be detected over the entire discharge electrode. Thus, a determination can be easily made as to whether the discharge electrode is contaminated or damaged. If the discharge electrode is contaminated, a determination can be easily made as to which portion of the discharge electrode is contaminated.

According to another preferred embodiment of the present invention, the image forming device includes a cleaning member which cleans the discharge electrode. The detector detects a first current value as a value of the electric current discharged from the discharge electrode prior to the cleaning operation by the cleaning member, and a second current value as a value of the electric current discharged from the discharge electrode after the cleaning operation has been performed by the cleaning member. A comparison device compares the first current value and the second current value detected by the detector.

According to this preferred embodiment, the detector detects the first current value prior to the cleaning operation and the second current value after the cleaning operation, and the comparison device compares the first current value and the second current value detected by the detector. Therefore, an effect of the cleaning operation by the cleaning member can be easily confirmed, and a determination can be easily made as to the portion where an additional cleaning operation is necessary. When the desired results of the cleaning operation by the cleaning member cannot be confirmed, a determination can be easily made that the life-span of the discharge electrode has ended.

According to another preferred embodiment of the present invention, the discharge electrode, the grid electrode and the detector are connected to a power source. An electric current of the current value detected by the detector is supplied to the grid electrode.

According to this preferred embodiment, the discharge electrode, the grid electrode, the detector and the power source are preferably arranged to define a closed circuit. Therefore, since the electric current of the current value detected by the detector is supplied to the grid electrode, even when the detector is provided on the grid electrode, a decrease of an electric potential of the grid electrode can be prevented.

Other features, elements, processes, steps, characteristics and advantages of the present invention will become more apparent from the following detailed description of preferred embodiments of the present invention with reference to the attached drawings.

DETAILED DESCRIPTION OF THE PREFERRED EMBODIMENTS

Preferred embodiments of the present invention will be described below. Further, the preferred embodiments to be described below are only preferred specific examples for implementing the present invention. Therefore, there are various examples of technical limitations in the following description. However, unless explicitly stated in the following description, the present invention shall not be limited to the preferred embodiments described herein.

With reference to the drawings, a description will be made of an image forming device 1 according to a preferred embodiment of the present invention. The image forming device 1 is preferably provided in a copying machine, a facsimile machine, or the like.

Figure 1:
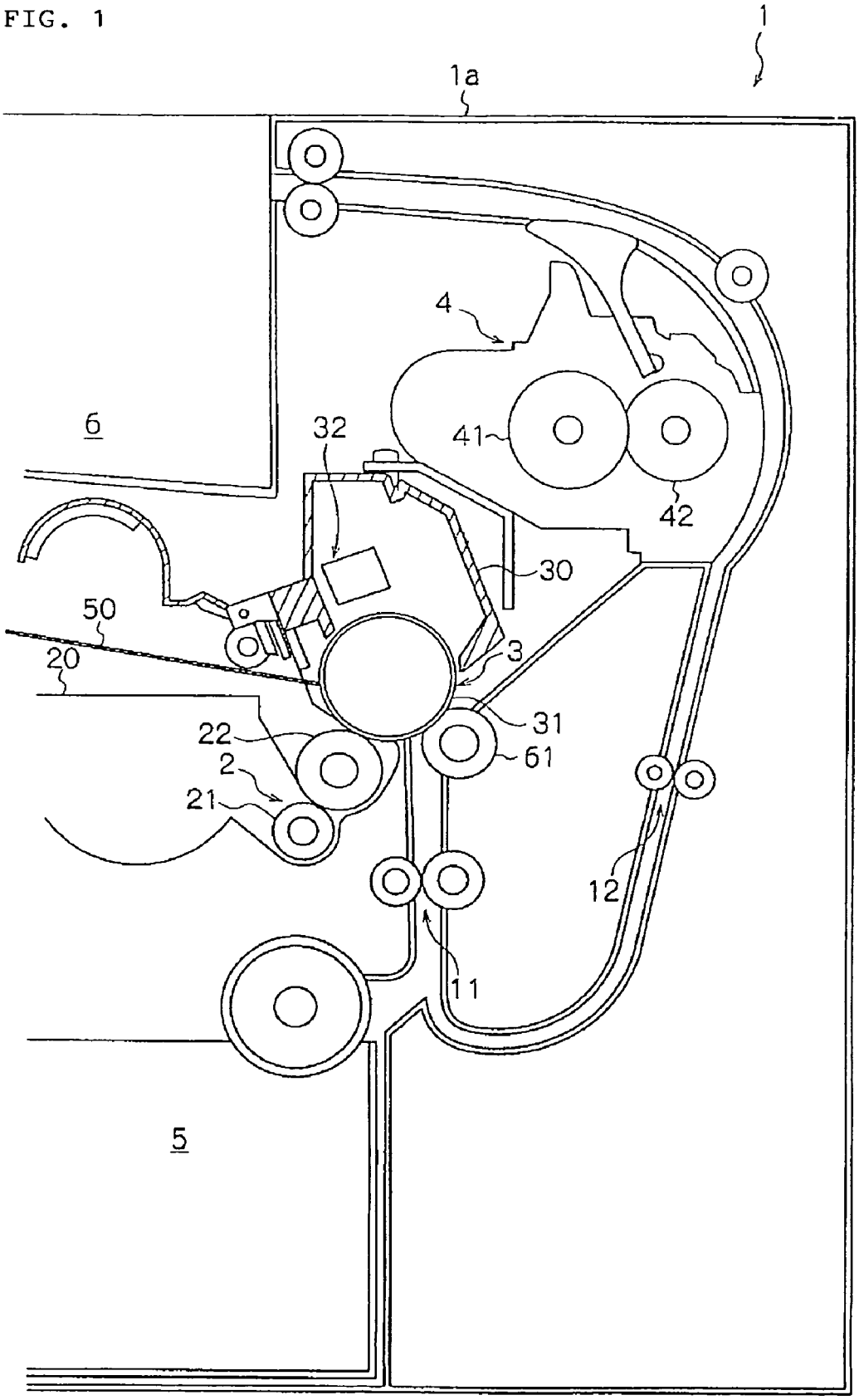
FIG. 1 is a schematic diagram showing a structure of an image forming device according to a preferred embodiment of the present invention.

As shown in FIG. 1, the image forming device 1 is arranged above a paper feed cassette 5. A paper discharge tray 6 is arranged in an upper portion of the image forming device 1. Inside the image forming device 1, a main transportation path 11 and a reversal path 12 are provided. The main transportation path 11 transports printing paper fed from the paper feed cassette 5 to the paper discharge tray 6. The reversal path 12 reverses the front and the back of the printing paper. The reversal path 12 is arranged at an outer side of the main transportation path 11, and diverges from and joins with the main transportation path 11. Inside the image forming device 1, a developing unit 2, a photoconductive drum unit 3 and a fixing unit 4 are provided, in this order, along the main transportation path 11 towards a downstream side (vertically upward).

The photoconductive drum unit 3 includes a photoconductive drum 31, a grid 37 (not shown in FIG. 1), and a charger 32, for example. The photoconductive drum 31 has a photoconductive layer on an outer circumferential surface as a photoconductor. The grid 37 applies a prescribed negative electric charge onto a surface of the photoconductive drum 31. The charger 32 charges the outer circumferential surface of the photoconductive drum 31. When a high voltage is applied to a discharge wire 33 (not shown in FIG. 1) of the charger 32, a corona discharge is generated. A negative electric charge is applied evenly to the outer circumferential surface of the photoconductive drum 31 by the corona discharge.

An exposing unit (not shown) is disposed diagonally above the photoconductive drum 31. The exposing unit includes a laser scanner unit, or the like. In accordance with input image information, the exposing unit irradiates an exposure ray 50 onto the outer circumferential surface of the photoconductive drum 31 charged by the charger 32. A negative electric charge of a portion irradiated by the exposure ray 50 is eliminated, and an electrostatic latent image corresponding to the image information is formed on the outer circumferential surface of the photoconductive drum 31.

The developing unit 2 includes a supply roller 21 and a developing roller 22, for example. While negatively charging toner from a toner case 20 accommodating the toner, the supply roller 21 supplies the toner to the developing roller 22. The developing roller 22 supplies the toner to the photoconductive drum 31 on which the electrostatic latent image is formed. The toner adheres only to the portion of the photoconductive drum 31 by an electrostatic force where the negative electric charge has been eliminated.

The fixing unit 4 includes a heat roller 41 and a press roller 42, which is arranged across the main transportation path 11 from the heat roller 41 so as to make contact with an outer circumferential surface of the heat roller 41. The printing paper is fed into a nip portion between the heat roller 41 and the press roller 42. The heat roller 41 and the press roller 42 heat and apply pressure to the printing paper after the transfer process. Accordingly, a toner image is fixed on the printing paper.

As described above, after the image information is formed on the printing paper fed from the paper feed cassette 5 and the toner image is fixed by the fixing unit 4, the printing paper is discharged onto the paper discharge tray 6.

The image forming device 1 has a front cover at a front side of the image forming device 1. The front cover can be opened and closed with respect to a device main body 1*a*. The front cover is mounted so as to be capable of being swung vertically with a lower position of the device main body 1*a* as a center of the swinging path of the front cover. When performing maintenance work on the photoconductive drum unit 3 or the like, the front cover is opened to the front, and a front side of the device main body 1*a* is exposed. Then, the photoconductive drum unit 3 is inserted or removed in a horizontal direction with respect to the device main body 1*a*, in a direction that is substantially perpendicular to a direction in which the printing paper is transported.

Figure 2:
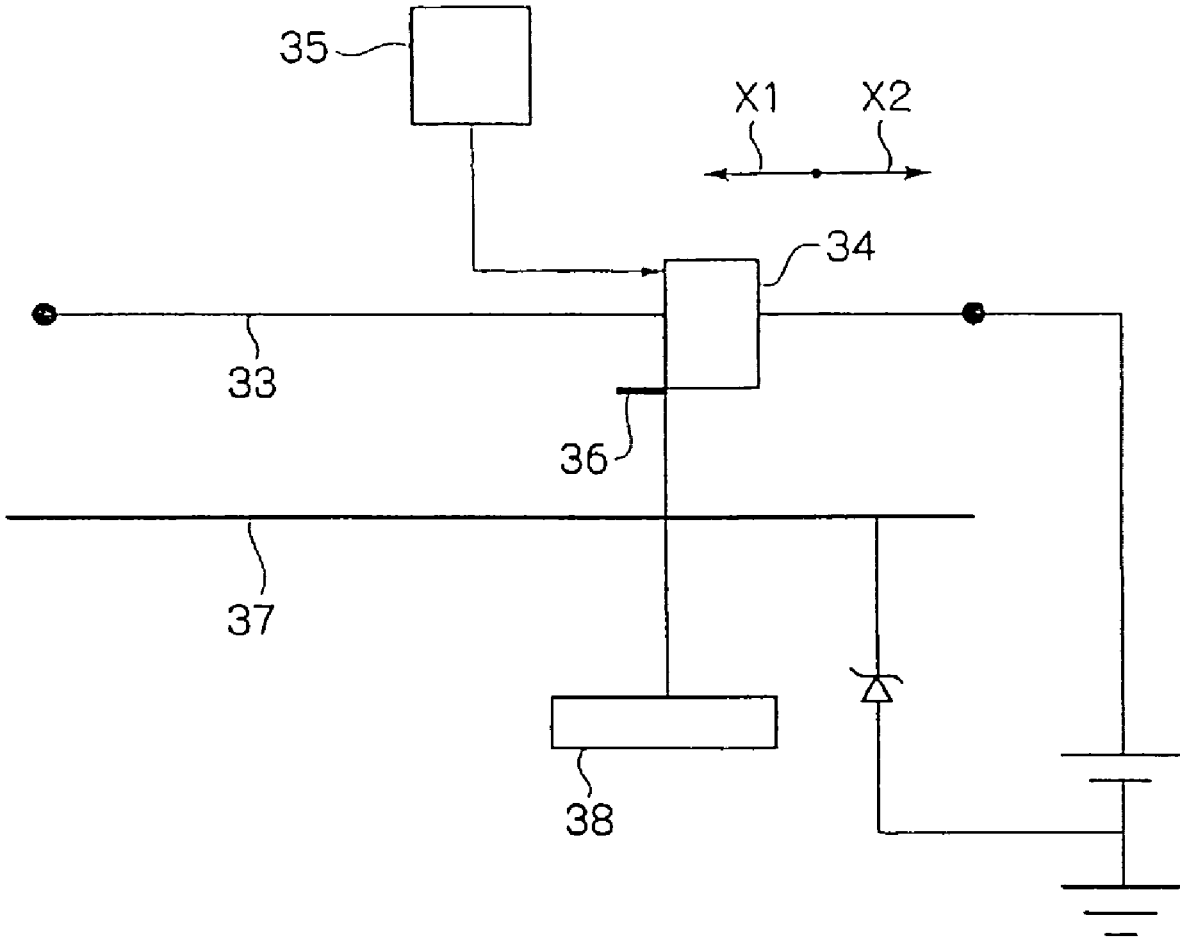
FIG. 2 is a schematic diagram of a cleaning member used in the image forming device.

Next, a description will be made of an example of the photoconductive drum unit, which is a principal part of the image forming device. As shown in FIG. 1 and FIG. 2, within the photoconductive drum unit 3, the photoconductive drum 31 is arranged in a lower portion (at a side of a transfer roller 61), and the charger 32 is arranged in an upper portion. The photoconductive drum 31 and the charger 32 are accommodated in a frame 30.

An opening is arranged at a lower portion (at the side of the transfer roller 61) of the frame 30. The photoconductive drum 31 is supported rotatably on the frame 30. A portion of the outer circumferential surface of the photoconductive drum 31 is exposed at the opening. The exposing unit irradiates the exposure ray 50 towards the outer circumferential surface of the photoconductive drum 31 exposed to the opening.

The charger 32 includes a discharge wire (discharge electrode) 33, a cleaning member 34, and a driving member 35. The discharge wire 33 discharges corona onto the surface of the photoconductive drum 31. The cleaning member 34 cleans the discharge wire 33. The driving member 35 moves the cleaning member 34 along the discharge wire 33. The grid 37 and the photoconductive drum 31 are located below the discharge wire 33. However, the cleaning member 34 may be moved manually.

As shown in FIG. 2, a detecting electrode (detector) 36 is preferably arranged on a lower portion of the cleaning member 34, at a first side in a moving direction of the cleaning member 34 (at a side in the direction of an arrow X1 in FIG. 2). The detecting electrode 36 detects a current value of the electric current discharged from the discharge wire 33. A comparison computing device (comparison device) 38 is connected to the detecting electrode 36 such that the comparison computing device 38 can transmit a signal. A value of each current value detected by the detecting electrode 36 is transmitted as data to the comparison computing device 38. The comparison computing device 38 compares a value of the electric current discharged from the discharge wire 33 prior to a cleaning operation by the cleaning member 34 (a first current value) and a value of the electric current discharged from the discharge wire 33 after the cleaning operation is preformed by the cleaning member 34 (a second current value), and carries out various computations. A computation result of the comparison computing device 38 is transmitted as data to a remote computer (not shown), or the like. This data is displayed on a display (not shown) preferably in the form of a graph shown in FIG. 4 and FIG. 5.

Further, in the above-described example of the photoconductive drum unit, a description is made using the discharge wire 33 as the discharge electrode. However, the present invention shall not be limited to this example of a preferred embodiment. For example, a needle electrode (not shown) may be used as the discharge electrode. In the above-described example, the detecting electrode 36, which is arranged on the cleaning member 34, is located above the grid 37. However, the present invention shall not be limited to this example of a preferred embodiment. For example, the detecting electrode may be located between the grid 37 and the surface of the photoconductive drum 31.

Next, a description will be made of an operation of the image forming device 1 according to a preferred embodiment of the present invention.

As shown in FIG. 2, the cleaning member 34 is driven by the driving member 35. When the cleaning member 34 moves from a first end towards a second end (in the direction of the arrow X1 in FIG. 2), a foreign substance adhered on the discharge wire 33 is removed from the discharge wire 33. Accompanying the movement of the cleaning member 34, the current value of the electric current discharged from the discharge wire 33 prior to the cleaning operation is detected by the detecting electrode 36. When the current value is detected by the detecting electrode 36, the detected current value is transmitted to the comparison computing device 38 as data of the current value prior to the cleaning operation. When such data is transmitted to the comparison computing device 38, the data is stored temporarily. As described above, when the cleaning member 34 moves on the discharge wire 33 from the first end to the second end of the discharge wire 33, the data of the current value of the electric current discharged from the discharge wire 33 prior to the cleaning operation can be obtained.

Meanwhile, when the cleaning member 34 moves on the discharge wire 33 to the second end of the discharge wire 33, the cleaning member 34 is driven by the driving member 35, and the cleaning member 34 then moves from the second end towards the first end (in the direction of an arrow X2 in FIG. 2). Accompanying the movement of the cleaning member 34, a value of the electric current discharged from the discharge wire 33 after the cleaning operation is detected by the detecting electrode 36. When the current value is detected by the detecting electrode 36, the detected current value is transmitted to the comparison computing device 38 as data of the current value after the cleaning operation. When such data is transmitted to the comparison computing device 38, the data is stored temporarily. As described above, when the cleaning member 34 moves on the discharge wire 33 from the second end to the first end of the discharge wire 33, the data of the current value of the electric current discharged from the discharge wire 33 after the cleaning operation can be obtained.

Next, the comparison computing device 38 compares the current value from the discharge wire 33 prior to the cleaning operation and the current value from the discharge wire 33 after the cleaning operation, and transmits the comparison result to the remote computer as data. A display of the remote computer displays the result preferably in the form of a graph in which a vertical axis represents a current value and a horizontal axis represents a position on the discharge wire 33 (refer to FIG. 3 and FIG. 4). By looking at the result displayed on the display, the user can determine whether the discharge wire 33 is contaminated or whether the discharge wire 33 is damaged. When the user determines that the discharge wire 33 is contaminated, the user can move the cleaning device 34 to further clean the discharge wire 33. When the user determines that the discharge wire 33 is damaged, the user can replace the damaged discharge wire 33 with a new discharge wire.

As described above, according to the image forming device 1 of the present preferred embodiment, the detecting electrode 36 is preferably arranged on one of the first side and the second side in the moving direction of the cleaning member 34. Therefore, the detecting electrode 36 can detect the current value of the electric current discharged from the discharge wire 33 while the cleaning member 34 is moving on the discharge wire 33. Accordingly, the current value can be detected at the same time as when the discharge wire 33 is cleaned. Furthermore, a determination can be made as to the life-span of the discharge wire 33 from the detected current value. Moreover, since the detecting electrode 36 is arranged on the cleaning member 34, compared with a structure in which the detecting electrode 36 is provided on another member that is moved along the discharge wire 33, the number of components can be reduced. As a result, the image forming device 1 can be decreased in size. Moreover, the comparison computing device 38 compares the current value from the discharge wire 33 prior to the cleaning operation and the current value from the discharge wire 33 after the cleaning operation. Therefore, an effect of the cleaning operation by the cleaning member 34 can be easily confirmed. In addition, a determination can be easily made as to the portion where an additional cleaning operation is necessary. When the desired results of the cleaning operation by the cleaning member 34 cannot be confirmed, the user or the service person can easily determine that the life-span of the discharge wire 33 has ended.

Figure 5:
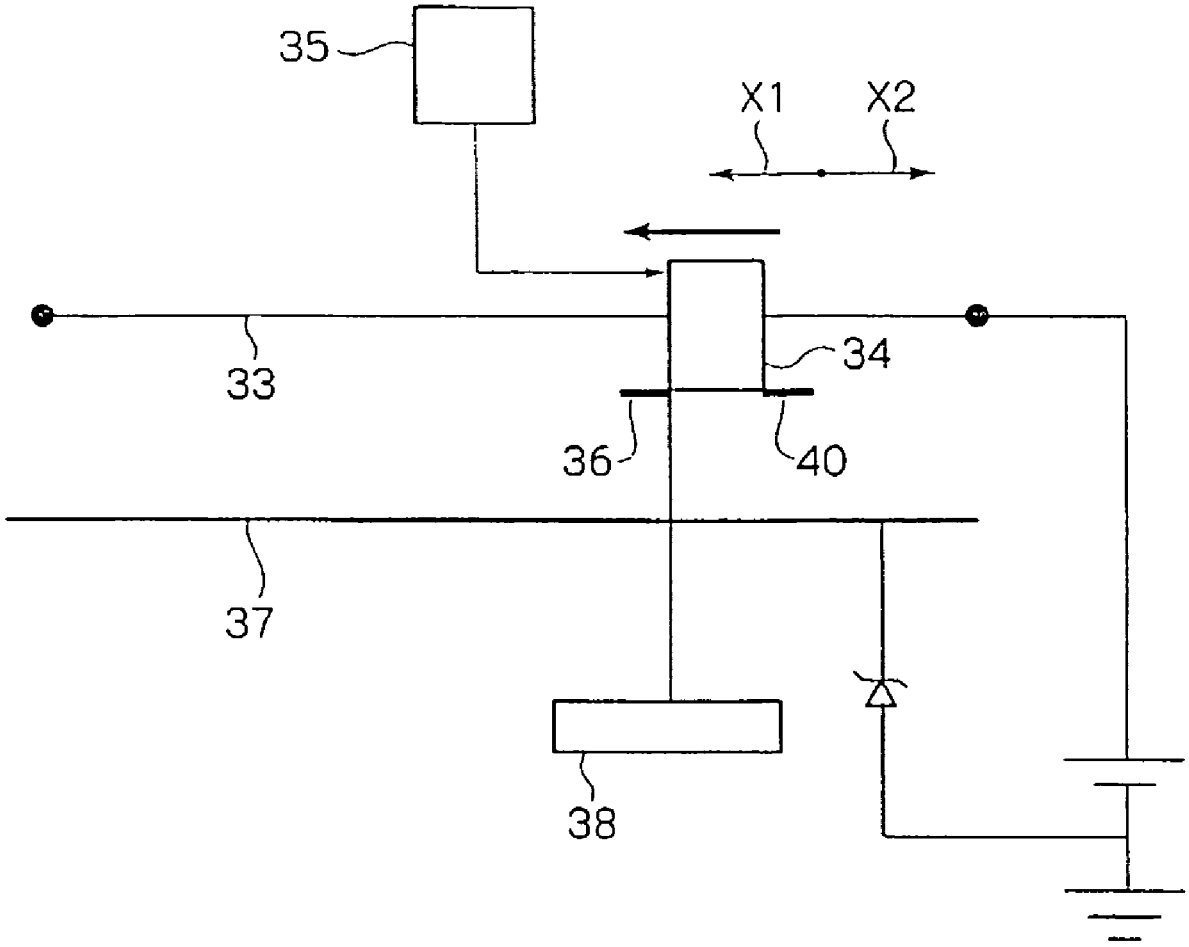
FIG. 5 shows a cleaning member used in the image forming device according to another preferred embodiment of the present invention.

Next, referring to FIG. 5, a description will be made of a second example of the photoconductive drum unit, which is a principal part of the image forming device. As shown in FIG. 5, a detecting electrode 40, which can detect a current value of an electric current discharged from the discharge wire 33, is arranged on the second side in the moving direction of the cleaning member 34 (at a side in the direction of an arrow X2 in FIG. 5). That is, the detecting electrodes 36 and 40 are respectively arranged on the first side in the moving direction of the cleaning device 34 (at the side in the direction of the arrow X1 in FIG. 5) and on the second side in the moving direction (at the side in the direction of the arrow X2 in FIG. 5). By moving the cleaning member 34 along the discharge wire 33 towards the first side in the moving direction (the side in the direction of the arrow X1 in FIG. 5, in other words, one-way movement) , the detecting electrode 36 can detect the current value of the electric current discharged from the discharge wire 33 prior to the cleaning operation (a first current value), and the detecting electrode 40 can detect the current value of the electric current discharged from the discharge wire 33 after the cleaning operation (a second current value) . Accordingly, the period of time required for detecting the current value can be considerably reduced.

Next, with reference to FIG. 6, a description will be made of a third example of the photoconductive drum unit, which is a principal part of the image forming device. In the third example, the grid electrode 37 and the photoconductive drum 31 (not shown in FIG. 6) are located below the discharge wire 33. The grid electrode 37 and the photoconductive drum 31 are provided over the entire length in the direction in which the discharge wire 33 extends (in a direction of an arrow X in FIG. 6). The grid electrode 37 is arranged in a mesh-form having opened parts and non-opened parts. At least one detecting electrode (detector) 136 is disposed at the non-opened parts. The detecting electrode 136 is disposed over the entire length in the direction in which the discharge wire 33 extends. The discharge wire 33, the grid electrode 37, and the detecting electrode 136 are connected to a power source 140. The discharge wire 33, the grid electrode 37, the detecting electrode 136, and the power source 140 preferably define a closed circuit. Therefore, the electric current detected by the detecting electrode 136 can be supplied to the grid electrode 37.

A comparison computing device (comparison device) 138 is connected to each detecting electrode 136 such that a signal can be transmitted. The comparison computing device 138 compares a current value of the electric current discharged from the discharge wire 33 prior to the cleaning operation (a first current value) and the current value of the electric current discharged from the discharge wire 33 after the cleaning operation (a second current value). The comparison computing device 138 is connected to the detecting electrode 136, and the value of each current value detected by the detecting electrode 136 is transmitted to the comparison computing device 138 as data. The computation result of the comparison computing device 138 is transmitted as data to a remote computer (not shown) and displayed on a display (not shown) in the form of a graph shown in FIG. 3 and FIG. 4. The comparison computing device 138 is connected to the driving member 35, and outputs a control signal to the driving member 35 for driving the cleaning member 34 when necessary.

Figure 4:
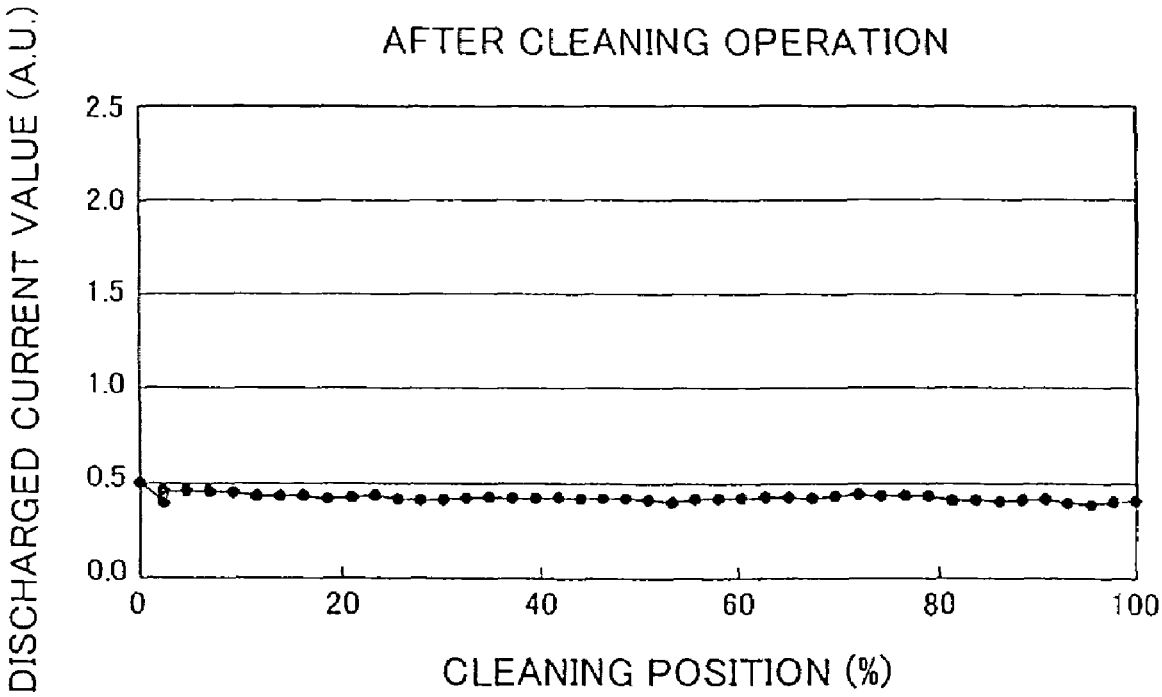
FIG. 4 is a graph showing a discharge current value of an electric current discharged from the discharge electrode after the cleaning operation.
Figure 6:
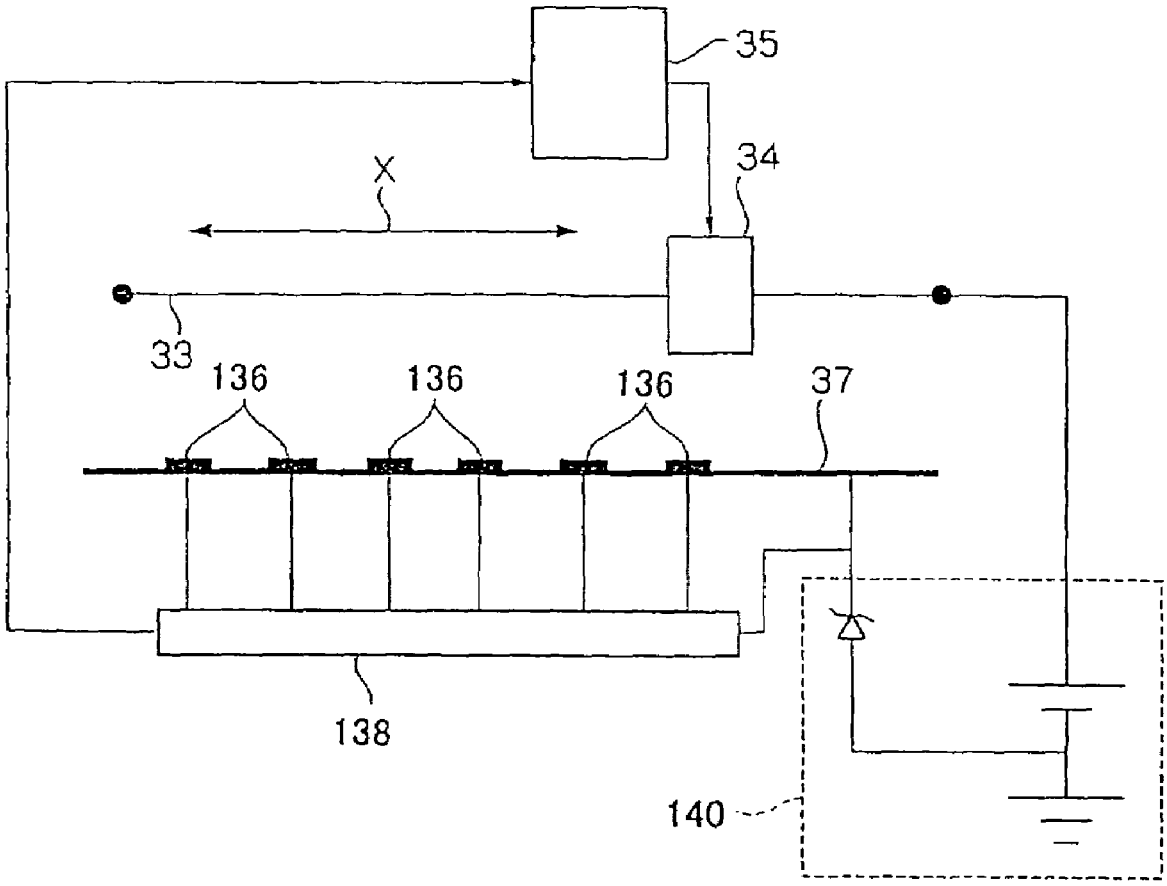
FIG. 6 shows a cleaning member used in the image forming device according to still another preferred embodiment of the present invention.

As shown in FIG. 6, the detecting electrode 136 detects the current value of the electric current discharged from the discharge wire 33. When the current value is detected by the detecting electrode 136, the detected current value is transmitted to the comparison computing device 138 as data. When such data is transmitted to the comparison computing device 138, the comparison computing device 138 carries out various computations. When the comparison computation device 138 determines that the detected current value varies or the detected current value (the first current value) is lower than a prescribed threshold value, a control signal is output from the comparison computing device 138 to the driving member 35. When a control signal is output from the comparison computing device 138 to the driving member 35, the cleaning member 34 moves along the discharge wire 33 and cleans the discharge wire 33. Further, the computation processing result of the current value by the comparison computing device 138 is displayed as shown in FIG. 4 on the display of the remote computer. A service person can easily confirm the result visually.

Figure 3:
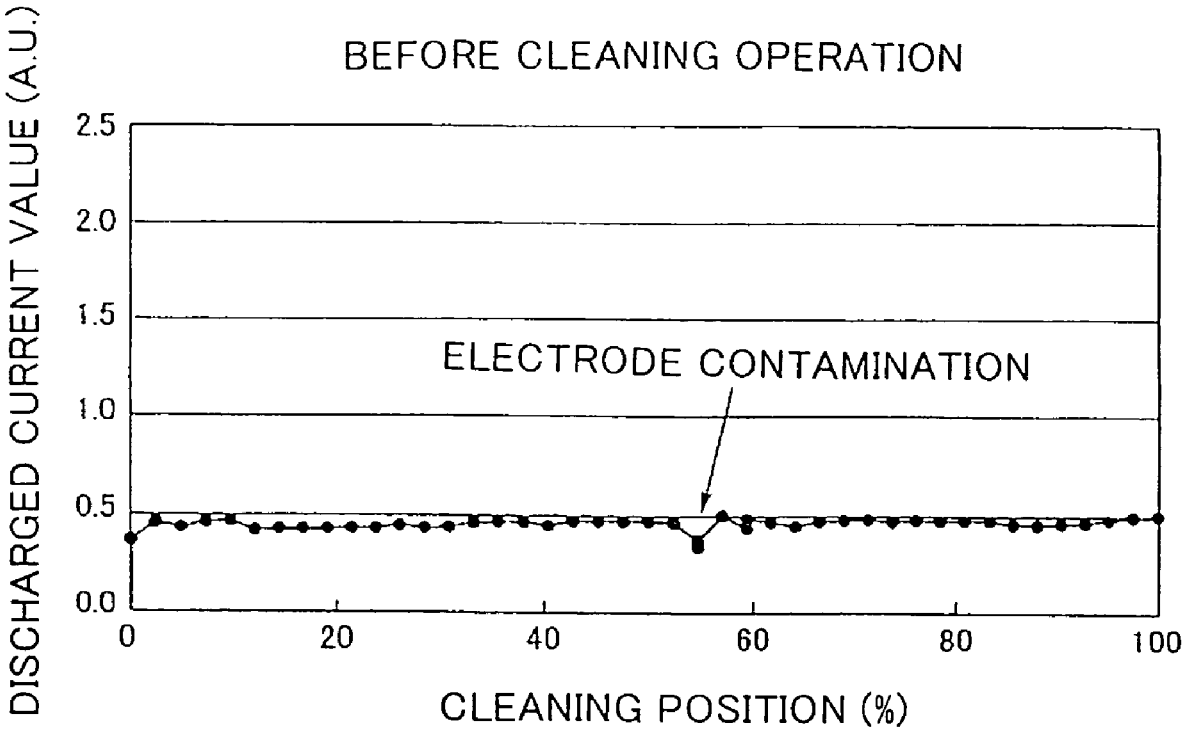
FIG. 3 is a graph showing a discharge current value of an electric current discharged from a discharge electrode prior to a cleaning operation.

Even after the cleaning operation has been performed by the cleaning member 34, a current value of the electric current discharged from the discharge wire 33 (a second current value) is detected by the detecting electrode 136, and a computation is carried out by the comparison computing device 138. Therefore, a determination can be made as to whether the detected current value varies or the detected current value is lower than the prescribed threshold value. When the comparison computing device 138 determines that the detected current value is not varying or the detected current value is not lower than the prescribed threshold value, a determination is made that the cleaning operation has been satisfactorily carried out and the discharge wire 33 may be left as it is. Further, since the computation operation result of the electric current by the comparison computing device 138 is displayed on the display of the remote computer as shown in FIG. 4, the user can easily confirm the result visually. Meanwhile, when the comparison computing device 138 determines that the detected current value varies or the detected current value is lower than the prescribed threshold value, a determination is made that there is no effect of the cleaning operation by the cleaning member 134 and that the life-span of the discharge wire 33 has ended. Further, in this case, a graph that is the same as the graph shown in FIG. 3 is preferably displayed on the display of the remote computer.

In the third example, the discharge wire 33, the grid electrode 37, the detecting electrode 136 and the power source 140 preferably are arranged to define a closed circuit. Therefore, the electric current detected by the detecting electrode 136 is supplied to the grid electrode 37. Even when the detecting electrode 136 is provided on the grid electrode 37, a decrease of an electric potential of the grid electrode 37 can be prevented.

While the present invention has been described with respect to preferred embodiments thereof, it will be apparent to those skilled in the art that the disclosed invention may be modified in numerous ways and may assume many embodiments other than those specifically set out and described above. Accordingly, it is intended by the appended claims to cover all modifications of the present invention that fall within the true spirit and scope of the invention.

What is claimed is:

1. An image forming device, comprising:

a photoconductive drum;

a discharge electrode which discharges corona onto a surface of the photoconductive drum;

a cleaning member which cleans the discharge electrode by moving along the discharge electrode; and a detection device arranged on one of a first side and a second side in a moving direction of the cleaning members and detects a current value of an electric current discharged from the discharge electrode.

2. The image forming device according to claim 1, wherein the detection device detects a first current value as a value of an electric current discharged from the discharge electrode prior to a cleaning operation performed by the cleaning member, and a second current value as a value of an electric current discharged from the discharge electrode after the cleaning operation has been performed by the cleaning member, and the image forming device further comprises a comparison device which compares the detected first current value and the detected second current value.

3. The image forming device according to claim 2, wherein after the cleaning operation has been performed by the cleaning member, when the comparison device determines that a difference between the first current value and the second current value is equal to or greater than a prescribed threshold value, a determination is made that a life-span of the discharge electrode has ended.

4. The image forming device according to claim 2, further comprising a computer including a display, wherein a comparison result of the comparison device is transmitted to the computer, and the computer displays the comparison result on the display.

5. The image forming device according to claim 2, further comprising a driving member which moves the cleaning member, wherein when the comparison device determines that a difference between the first current value and the second current value is equal to or greater than a prescribed threshold value, the comparison device outputs a control signal to the driving member, the driving member that received the control signal is driven, and the cleaning member moves on the discharge electrode to clean the discharge electrode.

6. The image forming device according to claim 2, further comprising a second detection device, wherein the first and second detection devices are arranged on both the first side and the second side in the moving direction of the cleaning member.

7. An image forming device, comprising:

a photoconductive drum;

a discharge electrode which discharges corona onto a surface of the photoconductive drum;

a cleaning member which cleans the discharge electrode by moving on the discharge electrode; and two detection devices, wherein the detection devices are arranged on both a first side and a second side in a moving direction of the cleaning member and detect a current value of an electric current discharged from the discharge electrode.

8. The image forming device according to claim 7, wherein one of the two detection devices detects a first current value as a value of an electric current discharged from the discharge electrode prior to a cleaning operation performed by the cleaning member, and another one of the detection devices detects a second current value as a value of an electric current discharged from the discharge electrode after the cleaning operation has been performed by the cleaning member, and the image forming device further comprises a comparison device which compares the detected first current value and the detected second current value.

9. The image forming device according to claim 8, wherein after the cleaning operation by the cleaning member, when the comparison device determines that a difference between the first current value and the second current value is equal to or greater than a prescribed threshold value, a determination is made that a life-span of the discharge electrode has ended.

10. The image forming device according to claim 8, further comprising a computer including a display, wherein a comparison result of the comparison device is transmitted to the computer, and the computer displays the comparison result on the display.

11. The image forming device according to claim 8, further comprising a driving member which moves the cleaning member, wherein when the comparison device determines that a difference between the first current value and the second current value is equal to or greater than a prescribed threshold value, the comparison device outputs a control signal to the driving member, the driving member that received the control signal is driven, and the cleaning member moves on the discharge electrode to clean the discharge electrode.

12. An image forming device, comprising:

a photoconductive drum;

a discharge electrode which discharges corona onto a surface of the photoconductive drum;

a cleaning member which cleans the discharge electrode;

a grid electrode which is provided along a direction in which the discharge electrode extends;

at least one detection device which is provided on the grid electrode and detects a current value of an electric current discharged from the discharge electrode; and a driving member which moves the cleaning member; wherein the at least one detection device detects a first current value as a value of an electric current discharged from the discharge electrode prior to a cleaning operation by the cleaning member, and a second current value as a value of an electric current discharged from the discharge electrode after the cleaning operation by the cleaning member;

the image forming device further comprises a comparison device which compares the first current value and the second current value detected by the at least one detection device; and when the comparison device determines that a difference between the first current value and the second current value is equal to or greater than a prescribed threshold value, the comparison device outputs a control signal to the driving member, the driving member that received the control signal is driven, and the cleaning member moves on the discharge electrode to clean the discharge electrode.

13. The image forming device according to claim 12, further comprising a computer including a display, wherein a comparison result of the comparison device is transmitted to the computer, and the computer displays the comparison result on the display.

14. The image forming device according to claim 12, further comprising a power source, wherein the discharge electrode, the grid electrode and the at least one detection device are connected to the power source, and an electric current detected by the at least one detection device is supplied to the grid electrode.

* * * * *

UNITED STATES PATENT AND TRADEMARK OFFICE

CERTIFICATE OF CORRECTION

PATENT NO. : 7,664,423 B2
APPLICATION NO. : 11/264351
DATED : February 16, 2010
INVENTOR(S) : Takahiro Sasai It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1169 days.

Signed and Sealed this

Thirtieth Day of November, 2010

David J. Kappos

David J. Kappos
*Director of the United States Patent and Trademark Office*